US010741045B2

(12) United States Patent
Gross

(10) Patent No.: US 10,741,045 B2
(45) Date of Patent: Aug. 11, 2020

(54) CHILD EMERGENCY MONITORING AND REPORTING SYSTEM AND METHOD

(71) Applicant: Andrew C Gross, Powhatan, VA (US)

(72) Inventor: Andrew C Gross, Powhatan, VA (US)

( * ) Notice: Subject to any disclaimer, the term of this patent is extended or adjusted under 35 U.S.C. 154(b) by 0 days.

(21) Appl. No.: 16/602,157

(22) Filed: Aug. 17, 2019

(65) Prior Publication Data

US 2020/0066131 A1 Feb. 27, 2020

Related U.S. Application Data

(60) Provisional application No. 62/720,333, filed on Aug. 21, 2018.

(51) Int. Cl.
*G08B 21/04* (2006.01)
*G08B 21/02* (2006.01)

(52) U.S. Cl.
CPC ..... *G08B 21/0423* (2013.01); *G08B 21/02* (2013.01)

(58) Field of Classification Search
CPC ..... G08B 21/0423; G08B 21/02
USPC ..... 340/573.1
See application file for complete search history.

(56) References Cited

U.S. PATENT DOCUMENTS 8,212,665 B2 * 7/2012 Schoenberg ..... B60N 2/002 307/10.1
9,189,942 B2 * 11/2015 Roston ..... G08B 21/0261
10,438,479 B1 * 10/2019 Guidotti ..... B60Q 1/50
2015/0242820 A1 * 8/2015 Oz ..... G06F 16/951 705/7.21
2017/0169366 A1 * 6/2017 Klein ..... G06Q 50/30
2018/0065504 A1 * 3/2018 Lan ..... B60W 10/30

FOREIGN PATENT DOCUMENTS

WO WO-2008156272 A2 * 12/2008 ..... G06Q 10/10

* cited by examiner

*Primary Examiner* — John A Tweel, Jr.

(57) ABSTRACT

A system and method for providing child emergency monitoring services and reporting includes monitoring in real-time a current temperature associated with the geography of a daycare center; and executing an alert notification sequence based on at least one user not checking-in at a check-in device at the daycare center prior to an expected check-in time. Moreover, the alert notification sequence may be initiated when a current temperature exceeds a maximum predefined limit. Also provided is an intelligent child seat for use in vehicles that monitors ambient temperature in the vehicle along with other factors and provides emergency notification signals when the ambient temperature exceeds a predefined limit.

18 Claims, 4 Drawing Sheets

CHILD EMERGENCY MONITORING AND REPORTING SYSTEM AND METHOD

CROSS-REFERENCE TO RELATED APPLICATIONS

This application claims benefit and priority to U. S. Provisional Patent Application No. 62/720,333 filed on Aug. 21, 2018, entitled "ALERT FOR KEEPING CHILDREN PROTECTED AND SAFE," the disclosure of which is incorporated by reference herein in its entirety.

BACKGROUND

Field of the Disclosure

This present disclosure is generally related to a system and method for monitoring arrival times of monitored individuals at a daycare or similar facility and raising alerts based on certain conditions and, more specifically, the present disclosure is directed to system and method for monitoring arrival times of monitored individuals at a daycare or similar facility and raising alerts based on weather conditions and updated expected arrival times.

Related Art

Each year the public learns of a child or disabled individual being left in a hot car succumbing to hyperthermia or suffering other heat related trauma. Many times it is due to a change in routine, distraction or unfortunately even malicious intent by parents and guardians. When parents or guardians fail to drop off the child or dependent at their daycare facility there is no automatic "fail-safe" mechanism to alert a pre-determined list of caregivers or predefined parties that a child did not arrive at a expected time. Typically, the realization that a young child has been left in a hot car occurs by a parent finally coming to the realization later that day or a care giver reaching out to the parent to inquire about the absence. Unfortunately, many times this occurs much too late, or not at all. Heat stroke causes damage to a child when their body temperature reaches 104 degrees. According to a study by Arizona State University, a 2-year-old child would reach 104-degree body temperature within one hour in a car left in the sun and within two hours in the shade.

According to the National Highway Transportation Safety Administration there were 636 heatstroke child deaths between 1998 to 2014[2]. Of those deaths:

53% of children were "forgotten" by their care giver

17% of children were left intentionally by an adult

While many corporate and faith-based sponsored daycare facilities have computer software programs running in a computer or server (located locally or remotely) coupled to a database to manage building security, check in/out of children, communication with parents and automated billing, there are none that use an automated notification system that alerts pre-determined recipients that a child may be at risk of being forgotten.

SUMMARY OF THE DISCLOSURE

In one aspect, a system for emergency monitoring and reporting includes a first computer in communication with at least one check-in device configured to check-in a plurality of users at a daycare provider, the first computer coupled to a database, the database having a profile defined for each of the plurality of users, each profile defining an expected check-in time and at least one alert notification sequence having at least one destination, and a weather data source in communication with the first computer that provides a current temperature associated with a geographic location of the daycare provider, wherein the first computer monitors in real-time the current temperature and executes the alert notification sequence based on at least one user not checking-in at the at least one check-in device prior to the expected check-in time. The first computer may be a server remote to the daycare facility connected to the day care facility over a communication link. The check-in device may be one of: a bio-sensor device, a card reader and a computer. The first computer may receive a delay message from a user that adjusts the expected check-in time associated with the user. The at least one alert notification sequence may include a mode of communication for each of the at least one destination. The expected check-in time may be defined for each day of the week. The first computer may adjust the expected check-in time providing a rolling average expected check-in time. The rolling average expected check-in time may be calculated based on a day of the week. The first computer may be a computer located at a daycare facility. The first computer may monitor in real-time the current temperature and may execute the alert notification sequence based on at least one user not checking-in at the at least one check-in device prior to the expected check-in time, and the current temperature exceeds a predefined maximum temperature. The predefined maximum temperature may be adjusted by the first computer based on a current humidity level. The system may further include an intelligent child seat configured with one or more of: a weight sensor, a temperature sensing device, power source, a communication device for sending a message, a global positioning system GPS device. The intelligent child seat may be configured with a weight sensor, a temperature sensing device, a power source and a communication device for sending a message.

In one aspect, a method for emergency monitoring and reporting includes monitoring in real-time a current temperature associated with the geography of a daycare center, and executing an alert notification sequence based on at least one user not checking-in at a check-in device at the daycare center prior to an expected check-in time. The monitoring may be performed by a first computer and the alert notification sequence sends at least one alert over a network based on a user profile. The step of executing an alert sequence may be initiated when the monitored current temperature exceeds a predefined limit. The expected check-in time may be a rolling average expected check-in time. The method may further include defining a profile for a plurality of users that includes defining the alert sequence and mode of communication. The steps of monitoring and executing may be performed at a first computer located remote from the daycare facility.

In one aspect, a computer program product for emergency monitoring and reporting may be provided. The computer program product may comprise software embodied on non-transitory medium that when read and executed by a computer processor performs the following steps: monitoring in real-time a current temperature associated with the geography of a daycare facility, and executing an alert notification sequence based on at least one user not checking-in at a check-in device at the daycare center prior to an expected check-in time.

BRIEF DESCRIPTION OF THE DRAWINGS

The accompanying drawings, which are included to provide a further understanding of the disclosure, are incorporated in and constitute a part of this specification, illustrate embodiments of the disclosure and, together with the detailed description, serve to explain the principles of the disclosure. No attempt is made to show structural details of the disclosure in more detail than may be necessary for a fundamental understanding of the disclosure and the various ways in which it may be practiced. In the drawings.

DETAILED DESCRIPTION OF THE DISCLOSURE

Figure 1:
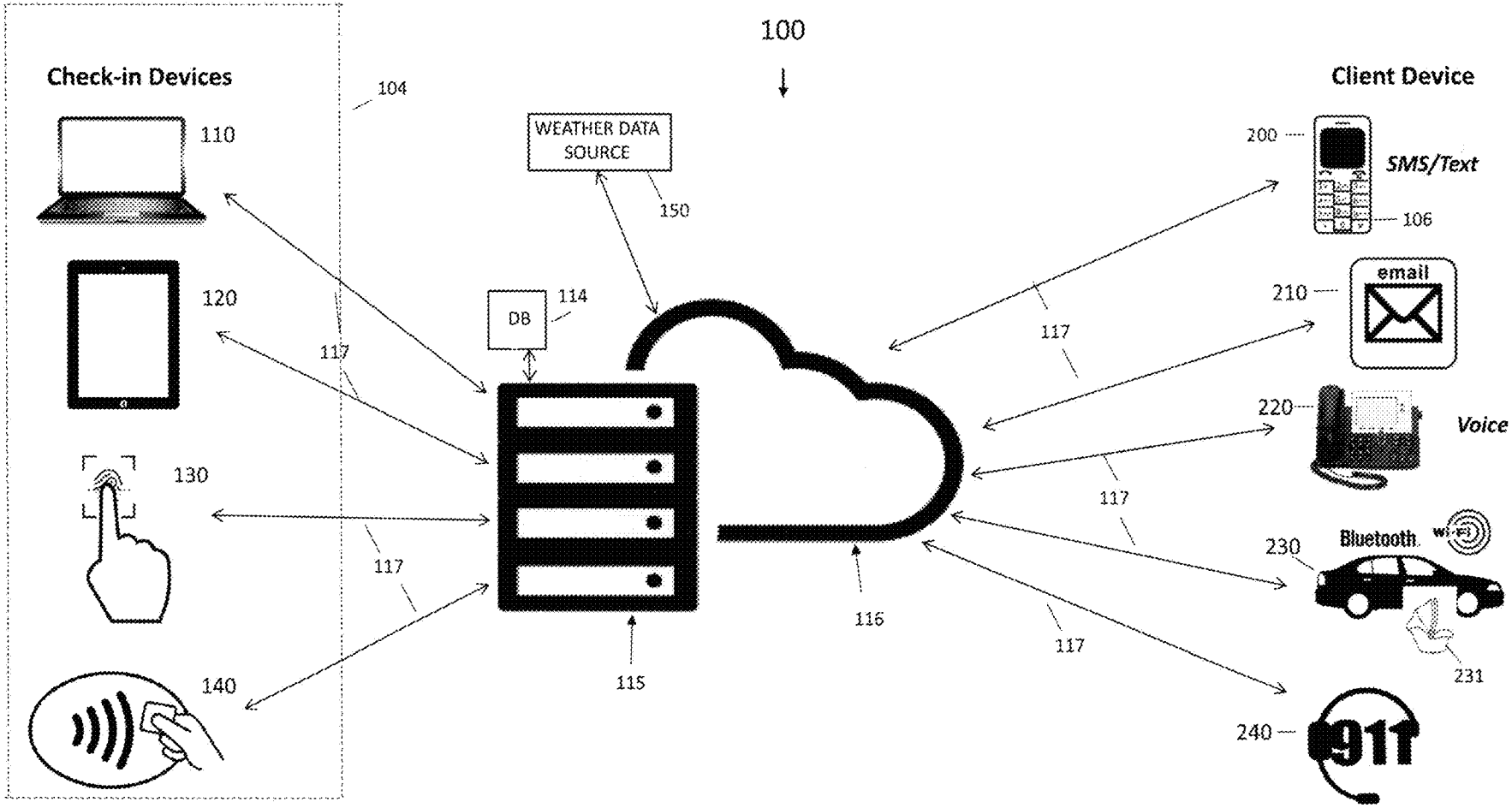
FIG. 1 is a block diagram of an example system architecture for the child emergency monitoring and reporting, configured according to principles of the disclosure.

The disclosure and the various features and advantageous details thereof are explained more fully with reference to the non-limiting examples that are described and/or illustrated in the accompanying drawings and detailed in the following description and attachment. It should be noted that the features illustrated in the drawings are not necessarily drawn to scale, and features of one example may be employed with other examples as the skilled artisan would recognize, even if not explicitly stated herein. Descriptions of well-known components and processing techniques may be omitted so as to not unnecessarily obscure the examples of the disclosure. The examples used herein are intended merely to facilitate an understanding of ways in which the invention may be practiced and to further enable those of skill in the art to practice the examples of the disclosure. Accordingly, the examples herein should not be construed as limiting the scope of the invention.

A "computer", also referred to as a "computing device," as used in this disclosure, means any machine, device, circuit, component, or module, or any system of machines, devices, circuits, components, modules, or the like, which are capable of manipulating data according to one or more instructions, such as, for example, without limitation, a processor, a microprocessor, a central processing unit, a general purpose computer, a super computer, a personal computer, a laptop computer, a palmtop computer, a notebook computer, a desktop computer, a workstation computer, a server, or the like, or an array of processors, microprocessors, central processing units, general purpose computers, super computers, personal computers, laptop computers, palmtop computers, cell phone, notebook computers, desktop computers, workstation computers, servers, or the like. Further, the computer may include an electronic device configured to communicate over a communication link. The electronic device may include, for example, but is not limited to, a mobile telephone, a personal data assistant (PDA), a mobile computer, a stationary computer, a smart phone, mobile station, user equipment, or the like. The computer may be equipped with a bus, input/output components, and memory.

A "server", as used in this disclosure, means any combination of software and/or hardware, including at least one application and/or at least one computer to perform services for connected clients as part of a client-server architecture. The at least one server application may include, but is not limited to, for example, an application program that can accept connections to service requests from clients by sending back responses to the clients. The server may be configured to run the at least one application, often under heavy workloads, unattended, for extended periods of time with minimal human direction. The server may include a plurality of computers configured, with the at least one application being divided among the computers depending upon the workload. For example, under light loading, the at least one application can run on a single computer. However, under heavy loading, multiple computers may be required to run the at least one application. The server, or any if its computers, may also be used as a workstation.

A "database", as used in this disclosure, means any combination of software and/or hardware, including at least one application and/or at least one computer. The database may include a structured collection of records or data organized according to a database model, such as, for example, but not limited to at least one of a relational model, a hierarchical model, a network model or the like. The database may include a database management system application (DBMS) as is known in the art. The at least one application may include, but is not limited to, for example, an application program that can accept connections to service requests from clients by sending back responses to the clients. The database may be configured to run the at least one application, often under heavy workloads, unattended, for extended periods of time with minimal human direction.

A "network," as used in this disclosure, means an arrangement of two or more communication links. A network may include, for example, a public network, a cellular network, the Internet, a local area network (LAN), a wide area network (WAN), a metropolitan area network (MAN), a personal area network (PAN), a campus area network, a corporate area network, a global area network (GAN), a broadband area network (BAN), any combination of the foregoing, or the like. The network may be configured to communicate data via a wireless and/or a wired communication medium. The network may include any one or more of the following topologies, including, for example, a point-to-point topology, a bus topology, a linear bus topology, a distributed bus topology, a star topology, an extended star topology, a distributed star topology, a ring topology, a mesh topology, a tree topology, or the like.

A "communication link", as used in this disclosure, means a wired and/or wireless medium that conveys data or information between at least two points. The wired or wireless medium may include, for example, a metallic conductor link, a radio frequency (RF) communication link, an Infrared (IR) communication link, an optical communication link, or the like, without limitation. The RF communication link may include, for example, WiFi, WiMAX, IEEE 802.11, DECT, 0G, 1G, 2G, 3G, 4G or 5G cellular standards, Bluetooth, or the like. A communication link may also include On-Star® a registered trademark of General Motors.

The terms "including", "comprising" and variations thereof, as used in this disclosure, mean "including, but not limited to", unless expressly specified otherwise.

The terms "a", "an", and "the", as used in this disclosure, means "one or more", unless expressly specified otherwise.

The term "daycare facility" or "daycare provider" as used herein means a business, organization or entity that provides caregiving services for children, or other individuals requiring special care such as, e.g., infirmed adults, or disabled persons. A "monitored individual" is a person for which the system 100 is providing an emergency monitoring service. The person may be a parent or guardian for which they may be responsible for one or more children or infirmed/disabled persons, and upon check-in at a daycare facility, the one or more children or infirmed/disabled person would be considered "checked-in." For a day care facility that tracks individual children (or infirmed/disabled person) at check-in rather than the parent or guardian, then the "monitored individual" would then be the child, or other person requiring daycare services.

Devices that are in communication with each other need not be in continuous communication with each other, unless expressly specified otherwise. In addition, devices that are in communication with each other may communicate directly or indirectly through one or more intermediaries.

Although process steps, method steps, algorithms, or the like, may be described in a sequential order, such processes, methods and algorithms may be configured to work in alternate orders. In other words, any sequence or order of steps that may be described does not necessarily indicate a requirement that the steps be performed in that order. The steps of the processes, methods or algorithms described herein may be performed in any order practical. Further, some steps may be performed simultaneously.

When a single device or article is described herein, it will be readily apparent that more than one device or article may be used in place of a single device or article. Similarly, where more than one device or article is described herein, it will be readily apparent that a single device or article may be used in place of the more than one device or article. The functionality or the features of a device may be alternatively embodied by one or more other devices which are not explicitly described as having such functionality or features.

A "computer-readable medium", as used in this disclosure, means any medium that participates in providing data (for example, instructions) which may be read by a computer. Such a medium may take many forms, including non-volatile media, volatile media, and physical transmission media. Non-volatile media may include, for example, optical or magnetic disks and other persistent memory. Volatile media may include dynamic random access memory (DRAM). Transmission media may include coaxial cables, copper wire and fiber optics, including the wires that comprise a system bus coupled to the processor. Common forms of computer-readable media include, for example, a floppy disk, a flexible disk, hard disk, magnetic tape, any other magnetic medium, a CD-ROM, DVD, any other optical medium, punch cards, paper tape, any other physical medium with patterns of holes, a RAM, a PROM, an EPROM, a FLASH-EEPROM, any other memory chip or cartridge, or any other non-transitory storage medium from which a computer can read.

FIG. 1 is a block diagram of an example system architecture for the child emergency monitoring and reporting, generally denoted as reference numeral 100, configured according to principles of the disclosure. The system 100 includes a first computer 115, that may be a server, coupled to a database 114. The database 114 for storing, updating and management of system data herein including, but not limited to, user information and profiles. The system 100 may further include one or more check-in devices typically located at a daycare facility 104 that may be a computer 110, a tablet 120, a bio-scanning device 130 such as reading a fingerprint, thumbprint or other bio characteristic, perhaps associated with a separate computer, operably connected to the first computer via communicating link 117. The daycare facility 104 typically would include a building or campus for providing caregiving operations for multiple users and/or monitored individuals. The check-in devices permit a user to easily notify system 100 of their arrival at the daycare facility, which by extension, includes arrival of one or more monitored individuals, e.g., one or more children. The first computer 115 may be located at a daycare facility 104, or it may be a remote service. The first computer 115 may also be a computer platform for running other software associated with the daycare facility 104, such as business software, account information, daycare records, employee or facility management software, and the like. The system 100 may further include a network 116 coupled to the first computer 115, a weather data source 150 that is capable of providing a current temperature on demand for a geographic area associated with the daycare facility 104. The weather data source 150 may also provide humidity data of the same geographic area associated with the daycare facility 104.

The system 100 may include one or more client devices comprising one or more of a short message service (SMS)/text-equipped computer based device 200, an email-enable device 210, a voice capable device 220 such as a cell phone or land line phone, an automobile 230 which may be Bluetooth, global positioning service (GPS) and/or WI-FI equipped. Automobile 230 may have an intelligent car seat 231 therewithin, as described more below, or may be equipped with a standard commercial child car seat. Any client device may be equipped with any combination of these capabilities, i.e., SMS/text, email, Bluetooth, GPS and/or WI-FI. In some implementations, the client devices may be coupled to a network 116 via a communication link 117 for communication with the first computer 115. Moreover, in some embodiments, the check-in devices may be coupled to the network 116, perhaps by link 117, to achieve communication with the first computer 115.

The client devices permit a user to receive alerts from first computer 115, or to contact the daycare facility 104, as needed. Any of the client devices, e.g., a cell phone, may also include a software application 106 configured to permit easy interface with first computer 115 to convey an anticipated arrival time at the day care facility, or to convey a message indicative of an amount of delay time from a normal arrival time at the daycare facility 104. For example, if a user typically arrives at the daycare facility 104 at 8:00 AM on Mondays, the application 106 can be configured to accept a user input indicating a delay of 25 minutes, perhaps due to traffic conditions; in this way, first computer 115 may temporarily adjust an expected arrival time by 25 minutes for this particular user.

System 100 may be operatively connectable to a 911 emergency center 240, which is an independent service from system 100, permitting personnel at the daycare facility 104 to contact emergency services as need arise, such as via phone calls, text or other messaging as support by the 911 emergency center 240, perhaps via link 117.

Figure 2:
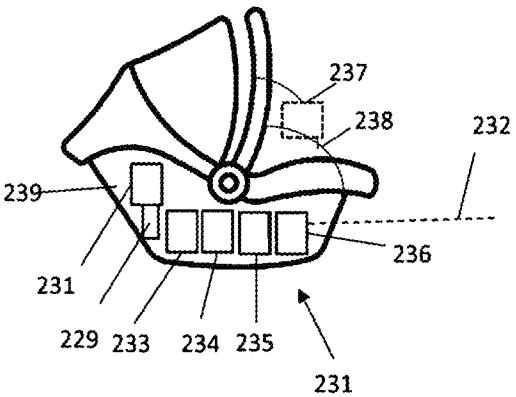
FIG. 2 is a block diagram of components of an intelligent child seat, configured according to principles of the disclosure.

FIG. 2 is a block diagram of components in an intelligent child seat, configured according to principles of the disclosure. The intelligent child seat 231 includes a hard shell body 239, such as hard plastic or composite material, configured to accept a sitting child therewithin, as is commonly known in the art. The child seat 231 includes a plurality of restraint straps 238 releasably connectable together via a releasable locking mechanism 237, also as known in the art. The child seat 231 further comprises a temperature sensor 233 to sense the ambient temperature of the immediate surroundings, typically within a vehicle. The temperature sensor 233 may be an electronic thermometer, a thermocouple device or the like. The temperature sensor 233 functions to provide an indication whenever a predetermined temperature has been reached. For example, in some embodiments the temperature sensor 233 may be calibrated to provide a signal when ambient temperature inside vehicle reaches 80° F. However, the temperature sensor 233 may be calibrated to provide a signal at any desired temperature, but typically, a temperature selected from a range of 75° F. to 95° F., preferably less than 88° F.

The child seat 231 includes a weight sensor 234 that detects that the car seat has weight on it, such as a child. The weight sensor 234 may be calibrated to provide a signal whenever a weight is detected that exceeds a predetermined weight, such as, e.g., 4 lbs., 5 lbs., 6 lbs, or a higher weight. The child seat 231 includes a communication device 235 that is configured to convey an emergency signal via a communication link that may be via WI-FI, Bluetooth, cell phone frequency. The communication device 235, or associated electronics, is preset to convey an external signal whenever the weight sensor 234 provides a signal indicating a weight greater than the predetermined weight and the temperature sensor 233 provides a signal indicating a temperature has reached the predetermined temperature and the releasable locking mechanism 237 is in the locked or closed position indicating that a child is being restrained within the child seat 231. The communication device 235 may send an emergency signal to the first computer 115 that includes an identifier of the car seat 231, which may be associated with registered user of system 100. In some embodiments, the communication device 235 may be configured to provide an emergency signal via OnStar®, or other communication link associated with vehicle 230. In some embodiments, a GPS device 231 may provide exact GPS coordinates of the car seat 231 (and presumably the associated vehicle) for inclusion with the emergency signal. Electronics 229 which may include a processor, provides coordination of the functions of weight sensor 234, communication device 235, GPS device 231, temperature sensor 233, and verifies the state of the releasable locking mechanism 237, and may initiate sending of any external signal.

In some embodiments, perhaps under control of electronics 229, the communication device 235 may be configured to provide an emergency signal by triggering an audible alert using the "panic feature" provided by most modern vehicles. This "panic" signal mimics the wireless signal normally provided by pushing a "panic" key of an electronic wireless key of the vehicle 230. Reception of the "panic" signal by the vehicle 230 results in the vehicle's horn sounding, which may cause a concerned nearby person to investigate the vehicle 230 for increased possible discovery of a child in distress. Both the "panic" signal and an external emergency signal, with or without GPS location, to the first computer 115 or other communication link may be sent. The first computer 115 may respond by performing one or more of: alerting one or more users as specified by an associated user profile, alerting daycare personnel, or even providing an automatic call to the 911 center 240 with pertinent identifying emergency information and GPS location.

The intelligent child seat 231 may include a power source 236 to power the various sensors and electronic components. The power source 236 may comprise a replaceable battery, a rechargeable battery and/or an external power connection 232. The external power connection 232 may be a universal serial bus (USB) type connection, a vehicle cigarette type connector, or other type of connection. The external power connection 232 may charge any rechargeable battery.

Figure 3:
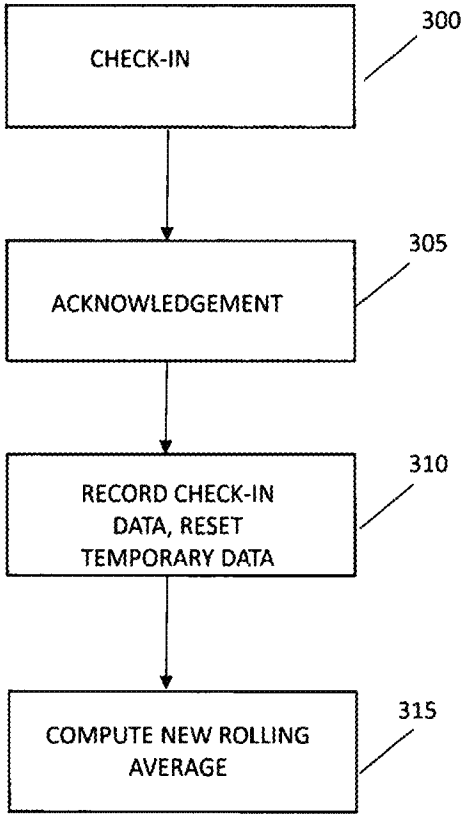
FIG. 3 is a flow diagram for check-in, the steps performed according to principles of the disclosure.

FIG. 3 is a flow diagram for check-in, the steps performed according to principles of the disclosure. All of the flow diagrams herein (i.e., FIGS. 3-6) may also represent a block diagram of the software component for performing the respective step. The software components, when executed by a suitable computer processor, performs the respective steps. The software components may be embodied on a computer-readable medium; and may comprise a computer program product.

At step 300, a user may check in at a daycare facility 104 using a check-in device, such as devices 110, 120, 130, 140. The check-in represents to the system 100, and first computer 115 specifically, that a child or other individual(s) are now under care of the daycare facility. At step 305, an acknowledgement indication is given to the user that the event has been recorded. At step 310, the first computer records the time, for the day of the week, and marks the appropriate monitored individual(s) as present at the daycare facility. Any temporary data such as expected check-in time that might have been modified (see Step 445 of FIG. 6) is reset to a preset expected time from the user's profile. The preset expected time may also be reset for all users at a predetermined time each day (e.g., at close of business) to the respective expect check-in time for the next day, for each user in the system 100 based on their respective user predefined profiles. The expected check-in time may change from day to day, depending on a user's predefined profile, maintained in database 114. It is possible that the next check-in time is null for the next day because a user is not expected to deliver a child on the next day. At step 315, the first computer 115 may compute a rolling average check-in time for the checked-in user based on the day of the week. This rolling average check-in time provides continuously learning by the system 100 on the typical time for each day of the week that a user typically checks-in. Each day of the week may have differing windows and different averages, which is related to user behavior factors like personal routine and traffic. This rolling average check-in time may be used as a basis to determine when a user may be late checking in to the daycare facility 104, and may be used as a basis for activating an emergency action based on other factors, like daily geographic temperature and humidity. The adjustment due to computed rolling averages may be limited by a predetermined maximum adjustment by a system 100 administrator. For example, the predetermined maximum adjustment may be limited to only 20 minutes maximum. This predetermined maximum adjustment may also be limited by the average seasonal temperature for the geographic region of the daycare facility 104. That is, in summer the predetermined maximum adjustment may be only 10 minutes, while in winter predetermined maximum adjustment may be 30 minutes. A system administrator may administer this seasonal setting.

Figure 4:
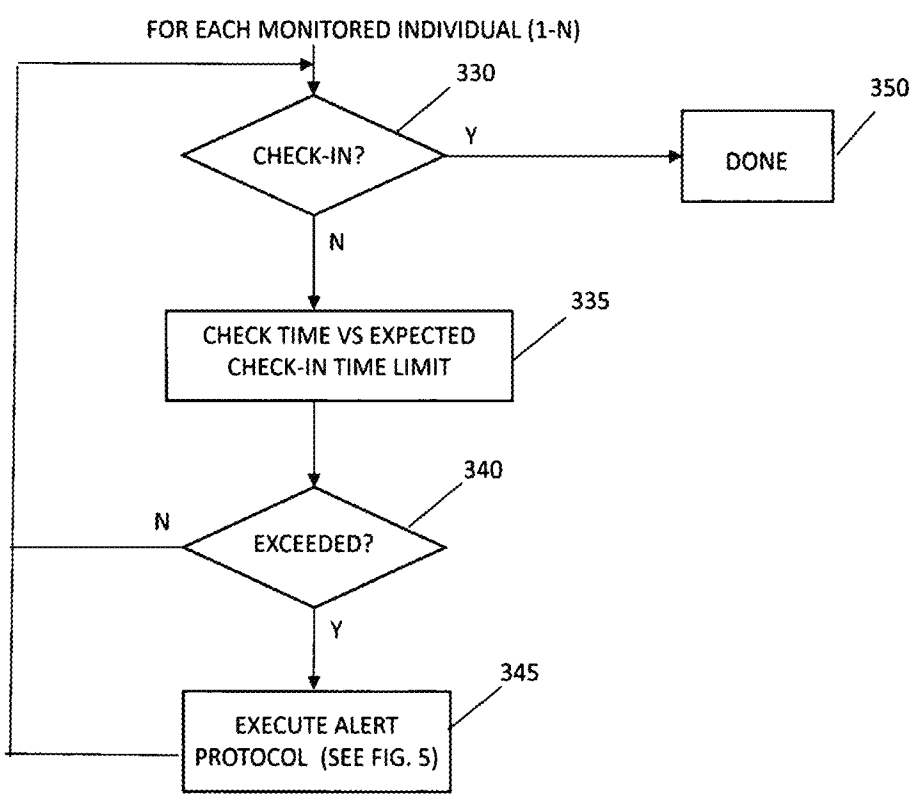
FIG. 4 is a flow diagram for monitoring check-ins, the steps performed according to principles of the disclosure.

FIG. 4 is a flow diagram for monitoring check-ins, the steps performed according to principles of the disclosure. This process monitors all expected users (1-N) for when they should be checking into the system 100 via check-in devices 110, 120, 130 or 140. This flow diagram illustrates a single instance of a flow, but is repeated for all registered users in real-time, on a daily basis, and as the daycare facility 104 is in operation. At step 330 a check is made if a particular user has checked-in (see, step 300) for the day.

If so, then the process for this particular user is done, and emergency monitoring is no longer needed this day, for this particular user. If, however, this particular user has not yet checked-in, then at step 335, a comparison is made between the current time and the expected check-in time for the day of the week, i.e., Monday, Tuesday, Wednesday, etc., as each day may be different according to the user's profile, and perhaps as adjusted by the computed rolling average check-in time for the day of the week (see step 315). The expected check-in time could also have been modified by the user for today, if the user provided a delay notice such as by using app 106. If the expected check-in time has not been exceeded, then the process continues at step 330.

Figure 5:
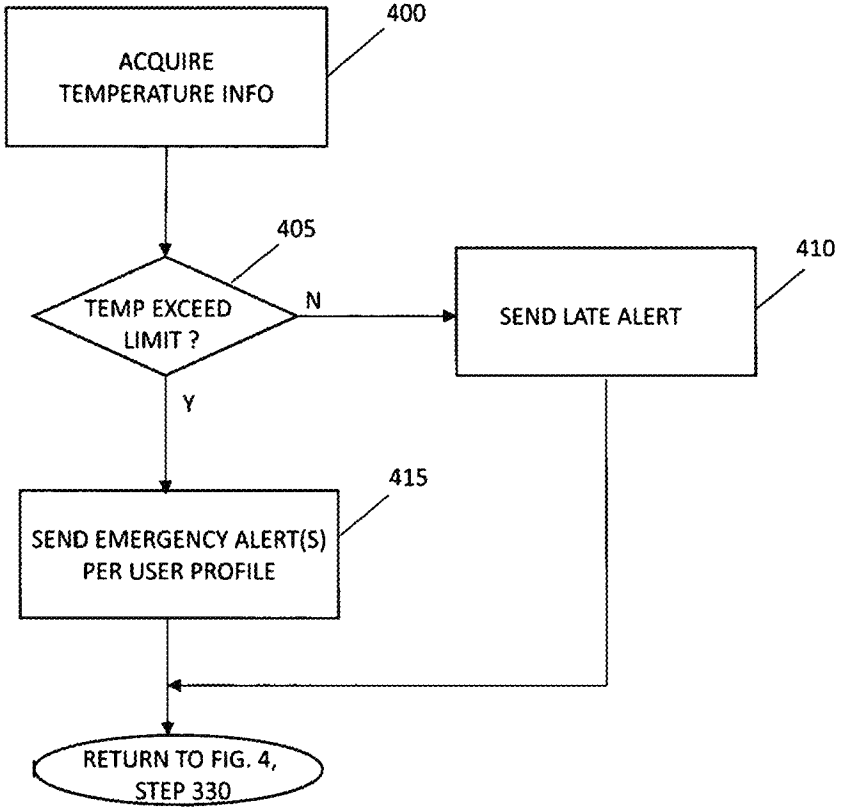
FIG. 5 is a flow diagram for executing an alert protocol, the steps performed according to principles of the disclosure.

If, however, the expected check-in time has been exceeded at step 340, then at stop 345 the alert protocol is invoked as described in FIG. 5. Once the alert protocol has been executed, the process may finish at step 350.

FIG. 5 is a flow diagram for executing an alert protocol, the steps performed according to principles of the disclosure. At step 400, temperature information may be acquired such as from a weather data source 150, which may be an on-line service for the geographic area of the daycare facility 104. A direct reading of a local temperature sensor may also be employed. Humidity data may also be acquired. At step 405, a check is made if the geographic temperature has exceeded a predetermined temperature considered safe for a child within a vehicle, and may have been forgotten. The predetermined temperature may be determined based on a combination of factors including a predefined maximum temperature set by a system administrator. This may be selected from a range of about 75° F. to about 90° F., preferably no higher than about 88° F. In some embodiments where the main concern is not heat but rather coldness, a different range may be set and selected to range from 32° F. or lower. The system 100 may be parametrically set to compensate and calculated in the reverse temperature direction. The system 100, specifically the first computer 115, may also adjust the predetermined temperature dynamically based on the current humidity, For example, the adjustment to the predetermined temperature may be accelerated based on a high humidity so that instead of a predefined maximum temperature set by the administrator, the predetermined maximum temperature may be lower automatically in relation to the humidity. For example, for every 10% humidity over 50%, the predefined maximum temperature may be lowered by adjustment factor, such as, e.g., 2° F. Any adjustment factor may be predefined. In this way, on hot humid days, the predetermined temperature is reached faster so that a dynamically adjustable safety factor is introduced based on both temperature and humidity.

If the check at step 405 is a no, then at step 410, a late alert may be issued (if not already done for this day), typically to the daycare facility that a particular user is late. Alternatively, an alert sequence defined in the user profile may be executed for this situation that includes the daycare provider, and may include only the day care provider. Since the predetermined temperature has not yet been exceeded, then no special alerting other than to the daycare facility is necessary at this time. If, however, at step 405 the check was positive, then at step 415, an emergency alert sequence may be commenced, (if not already done for this day). This sequence is predefined in the user's profile and stipulates the order of alerts, to whom to be given, and the mode of how the alert is to be given. The defined sequence may include a sequential order of people, including the day care provider, to be contacted, with a specified time delay (e.g., 0 to 120 seconds) between notifications, the mode for each person, i.e., text, phone call (predetermined voice message), email, or any combination of mode, per person designated within profile. Since the daycare entity is notified, the daycare facility may choose to take other action as well. The sequence may also stipulate that there is a simultaneous notification of two or more persons, in addition to, or alternatively to a serial sequence. That is, a combination of serial and parallel notifications can be specified. Processing may continue at step 330, of FIG. 4.

Figure 6:
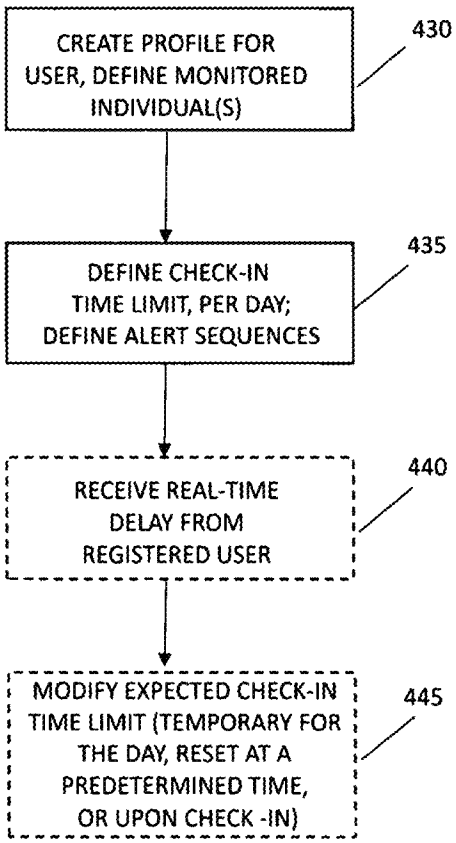
FIG. 6 is a flow diagram for defining profiles, including check-in times, alert sequences, and receiving real-time delays, the steps performed according to principles of the disclosure.

FIG. 6 is a flow diagram for defining profiles, including check-in times, alert sequences, and receiving real-time delays, the steps performed according to principles of the disclosure. At step 430, a system administrator, or other authorized and designated system 100 user, may establish and define a profile for individuals or system users to be monitored, i.e., the monitored individual(s) for storing in database 114. This may be associated with a parent or guardian. In some applications, each child may be profiled due to daycare provider policy or practice. At step 435, the profile may be defined to include a check-in time limit per day of the week, and can vary depending on the day of the week. This is the expected check-in time, as defined in the profile. Further, an alert sequence may be defined listing the person or people to be contacted, in what order, and by what mode. The system also accepts input for temporarily turning off notifications such as for vacation periods. At optional step 440, a user may dynamically send in real time and received by the first computer 115 to cause an adjustment to the expected check-in time. This may be due to traffic or other delay causing situation. This informs the system 100 that the user is expected to check-in at a later time. At step 445, the system 100 adjusts the expected check-in time limit defined in the profile. This is temporary for the day and is reset upon check-in by the user or at a predetermined time of the day, such as, e.g., at close of business.

The system and processes described herein permits a system 100 to provide a real-time monitoring and alert service to lessen the probability of a child left unattended in a hot vehicle. The system provides real-time monitoring based on temperature and humidity factors and adjusts dynamically as weather changes. The system provides alerting via one or more modes of communication to pre-defined alertable targets defined by user profiles. The system is intended to reduce reliance on human involvement thus expediting emergency response. In some embodiments 911 call centers may be included in the user profile to expedite this response based on defined mode of communication.

While the invention has been described in terms of examples, those skilled in the art will recognize that the invention can be practiced with modifications in the spirit and scope of the appended claims.

What is claimed:

1. A system for emergency monitoring and reporting, comprising:

a first computer in communication with at least one check-in device configured to check-in a plurality of users at a daycare provider, the first computer coupled to a database;

the database having a profile defined for each of the plurality of users, each profile defining an expected check-in time and at least one alert notification sequence having at least one destination; and a weather data source in communication with the first computer that provides a current temperature associated with a geographic location of the daycare provider, wherein the first computer monitors in real time the current temperature and executes the alert notification sequence to a profile associated with the user based on the current temperature exceeding a predetermined threshold and at least one user not checking-in at the at least one check-in device prior to the expected check-in time.

2. The system of claim 1, wherein the first computer is a server remote to the daycare facility connected to the day care facility over a communication link.

3. The system of claim 1, wherein the check-in device is one of: a bio-sensor device, a card reader and a computer.

4. The system of claim 1, wherein the first computer receives a delay message from a user that adjusts the expected check-in time associated with the user.

5. The system of claim 1, wherein the at least one alert notification sequence includes a mode of communication for each of the at least one destination.

6. The system of claim 1, wherein the expected check-in time is defined for each day of the week.

7. The system of claim 1, wherein the first computer adjusts the expected check-in time providing a rolling average expected check-in time.

8. The system of claim 7, wherein the rolling average expected check-in time is calculated based on a day of the week.

9. The system of claim 1, wherein the first computer is a computer located at a daycare facility.

10. The system of claim 1, wherein the predefined maximum temperature is adjusted by the first computer based on current humidity level.

11. The system of claim 1, wherein the system further includes an intelligent child seat configured with one or more of: a weight sensor, a temperature sensing device, power source, a communication device for sending a message, a global positioning system GPS device.

12. The system of claim 11, wherein the intelligent child seat is configured with a weight sensor, a temperature sensing device, a power source and a communication device for sending a message.

13. A method for emergency monitoring and reporting, comprising:

monitoring in real-time a current temperature associated with the geography of a daycare center; and executing an alert notification sequence to at least one user based on the current temperature exceeding a predetermined threshold and the at least one user not checking-in at a check-in device at the daycare center prior to an expected check-in time.

14. The method of claim 13, wherein the monitoring is performed by a first computer and the alert notification sequence sends at least one alert over a network based on a user profile.

15. The method of claim 13, wherein the expected check-in time is a rolling average expected check-in time.

16. The method of claim 13, further comprising defining a profile for a plurality of users that includes defining the alert sequence and mode of communication.

17. The method of claim 13, the steps of monitoring and executing is performed at a first computer located remote from the daycare facility.

18. A computer program product for emergency monitoring and reporting, the computer program product comprising software embodied on non-transitory medium that when read and executed by a computer processor performs the following steps:

monitoring in real-time a current temperature associated with the geography of a daycare facility; and executing an alert notification sequence to at least one user based on the current temperature exceeding a predetermined threshold and the at least one user not checking-in at a check-in device at the daycare facility prior to an expected check-in time.

* * * * *